US009739000B2

(12) United States Patent
Shimizu et al.

(10) Patent No.: US 9,739,000 B2
(45) Date of Patent: Aug. 22, 2017

(54) MULTI-NEEDLE SEWING MACHINE

(71) Applicant: BROTHER KOGYO KABUSHIKI KAISHA, Nagoya, Aichi (JP)

(72) Inventors: Akie Shimizu, Nagoya (JP); Yoshio Nishimura, Nagoya (JP); Yutaka Nomura, Anjo (JP); Yuki Ihira, Kakamigahara (JP); Manami Ota, Nagoya (JP); Hidenori Oka, Tokai (JP); Satoru Ichiyanagi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 358 days.

(21) Appl. No.: 14/559,387

(22) Filed: Dec. 3, 2014

(65) Prior Publication Data

US 2015/0184321 A1 Jul. 2, 2015

(30) Foreign Application Priority Data

Dec. 27, 2013 (JP) ..... 2013-272141

(51) Int. Cl.

| | |
|---|---|
| ***D05B 1/08*** | (2006.01) |
| ***D05B 79/00*** | (2006.01) |
| ***D05B 51/00*** | (2006.01) |
| ***D05C 13/00*** | (2006.01) |

(52) U.S. Cl.

CPC ..... *D05B 79/00* (2013.01); *D05B 51/00* (2013.01); *D05C 13/00* (2013.01)

(58) Field of Classification Search

CPC ..... D05B 19/08; D05B 19/02; D05B 19/06; D05B 19/12; D05B 19/14

USPC ..... 112/102.5, 475.19, 222, 163

See application file for complete search history.

(56) References Cited

U.S. PATENT DOCUMENTS

| | | | | |
|---|---|---|---|---|
| 4,341,170 A * | 7/1982 | Beckerman | D05B 19/105 | 112/445 |
| 5,042,410 A * | 8/1991 | Nakashima | D05B 19/02 | 112/153 |
| 5,072,680 A * | 12/1991 | Nakashima | D05B 79/00 | 112/445 |
| 5,095,835 A * | 3/1992 | Jernigan | D05B 19/08 | 112/103 |
| 5,195,451 A | 3/1993 | Nakashima | | |
| 5,323,722 A * | 6/1994 | Goto | G05B 19/4205 | 112/102.5 |

(Continued)

FOREIGN PATENT DOCUMENTS

| | | |
|---|---|---|
| JP | A-5-15667 | 1/1993 |

*Primary Examiner* — Tejash Patel
(74) *Attorney, Agent, or Firm* — Oliff PLC

(57) ABSTRACT

A multi-needle sewing machine includes a plurality of needle bars, a needle bar case having a thread supply path along which threads are supplied to needles attached to lower ends of the needle bars respectively, the needle bar case supporting the needle bars, an arm on which the needle bar case is mounted, an embroidery frame located below the needle bar case and configured to hold a workpiece cloth, a projector configured to project an image onto the workpiece cloth from above the embroidery frame, and a support member supporting the projector and configured to be capable of switching the projector between a first position where the image is projectable onto the workpiece cloth and a second position differing from the first position.

12 Claims, 14 Drawing Sheets

(56) References Cited

U.S. PATENT DOCUMENTS

| | | | | |
|---|---|---|---|---|
| 5,553,559 | A * | 9/1996 | Inoue | D05B 19/085 112/102.5 |
| 6,161,491 | A * | 12/2000 | Takenoya | D05B 19/02 112/102.5 |
| 6,792,865 | B2 * | 9/2004 | Brunet-Manquat | B41F 33/0036 101/129 |
| 7,212,880 | B2 * | 5/2007 | Mizuno | D05B 19/08 112/102.5 |
| 8,197,080 | B2 | 6/2012 | Fujihara et al. | |
| 9,127,384 | B2 * | 9/2015 | Ichiyanagi | D05B 19/12 |
| 9,267,222 | B2 * | 2/2016 | Schnaufer | D05B 19/12 |

* cited by examiner

MULTI-NEEDLE SEWING MACHINE

CROSS-REFERENCE TO RELATED APPLICATIONS

This application is based upon and claims the benefit of priority from the prior Japanese Patent Application No. 2013-272141 filed on Dec. 27, 2013, the entire contents of which are incorporated herein by reference.

BACKGROUND

1. Technical Field

The present disclosure relates to a multi-needle sewing machine including a plurality of needle bars and a needle bar case supporting the needle bars.

2. Related Art

There has conventionally been known a sewing machine provided with a projector which projects an image onto an object. For example, a household sewing machine includes a single needle bar and a projector mounted on a head of the sewing machine. In use of the sewing machine, the projector projects an image of embroidery pattern assuming a finished piece onto a workpiece cloth. A user can exactly confirm a position of the embroidery pattern before sewing while viewing the image of embroidery pattern projected on the workpiece cloth.

SUMMARY

It has been demanded to provide a projector as described above on a multi-needle sewing machine which is not for household use and has a plurality of needle bars. Since the multi-needle sewing machine has a different structure from the household sewing machines, it is desirable to dispose the projector at the front side of the needle bar case supporting the needle bars.

However, the multi-needle sewing machine is provided with a needle thread path along which a plurality of needle threads is fed to eyes of sewing needles attached to lower ends of needle bars respectively. The needle thread path is located at the front side of the needle bar case. Accordingly, when disposed at the front side of the needle bar case, the projector gets in the way of user's work to set needle threads along the needle thread path, with the result that the user has difficulty in setting the needle threads.

Therefore, an object of the disclosure is to provide a multi-needle sewing machine which is provided with a projector projecting an image onto the workpiece cloth and can prevent the projector from getting in the way of user's work to set needle threads along the needle thread path.

The disclosure provides a multi-needle sewing machine including a plurality of needle bars, a needle bar case having a thread supply path along which threads are supplied to needles attached to lower ends of the needle bars respectively, the needle bar case supporting the needle bars, an arm on which the needle bar case is mounted, an embroidery frame provided below the needle bar case and configured to hold a workpiece cloth, a projector configured to project an image onto the workpiece cloth from above the embroidery frame, and a support member supporting the projector and configured to be capable of switching the projector between a first position where the image is projectable onto the workpiece cloth and a second position differing from the first position.

DETAILED DESCRIPTION

Several embodiments will be described with reference to the accompanying drawings. Identical or similar parts will be designated by the same reference symbols throughout the embodiments.

Figure 1:
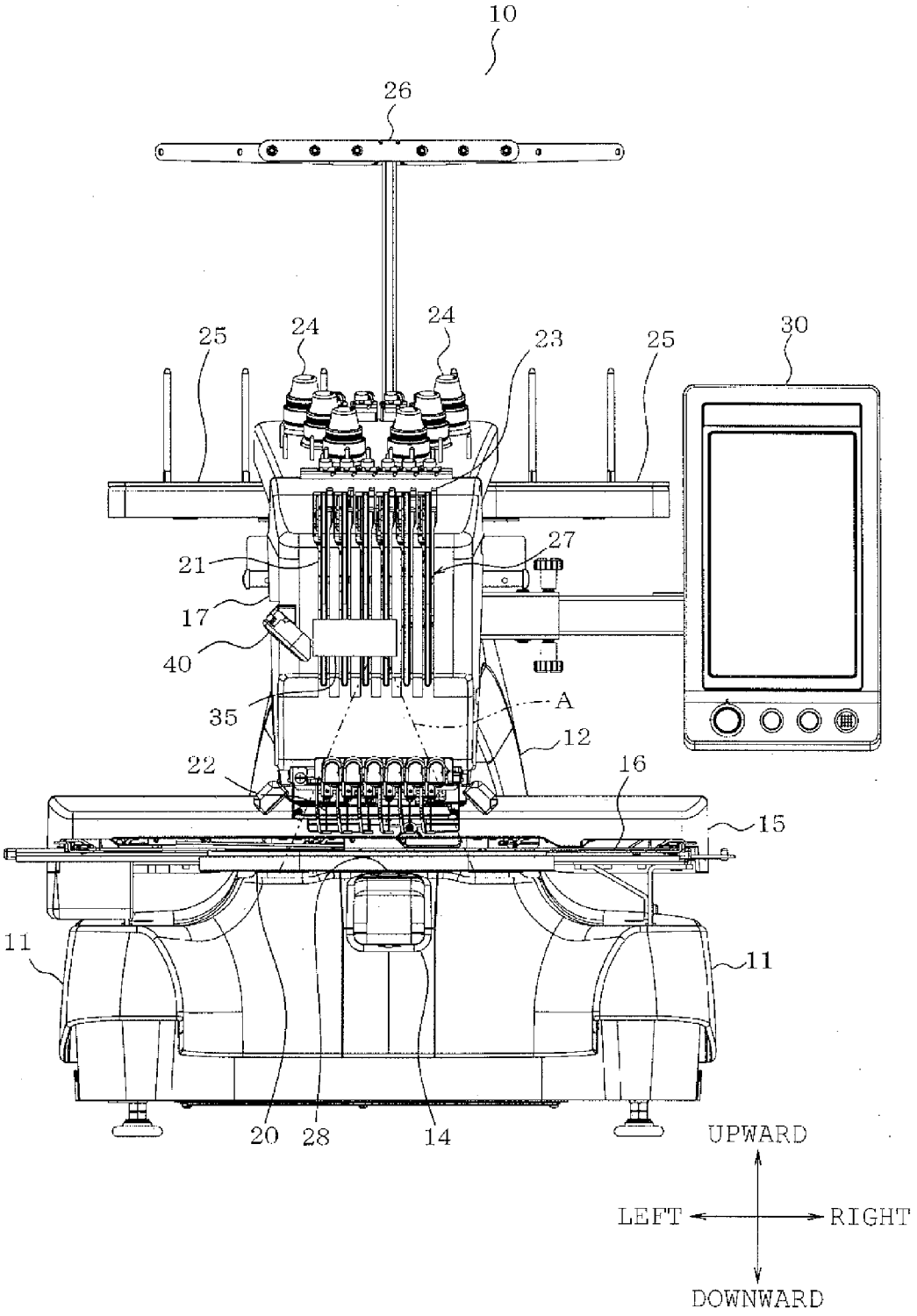
FIG. 1 is a front view of the multi-needle sewing machine according to a first embodiment.
Figure 2:
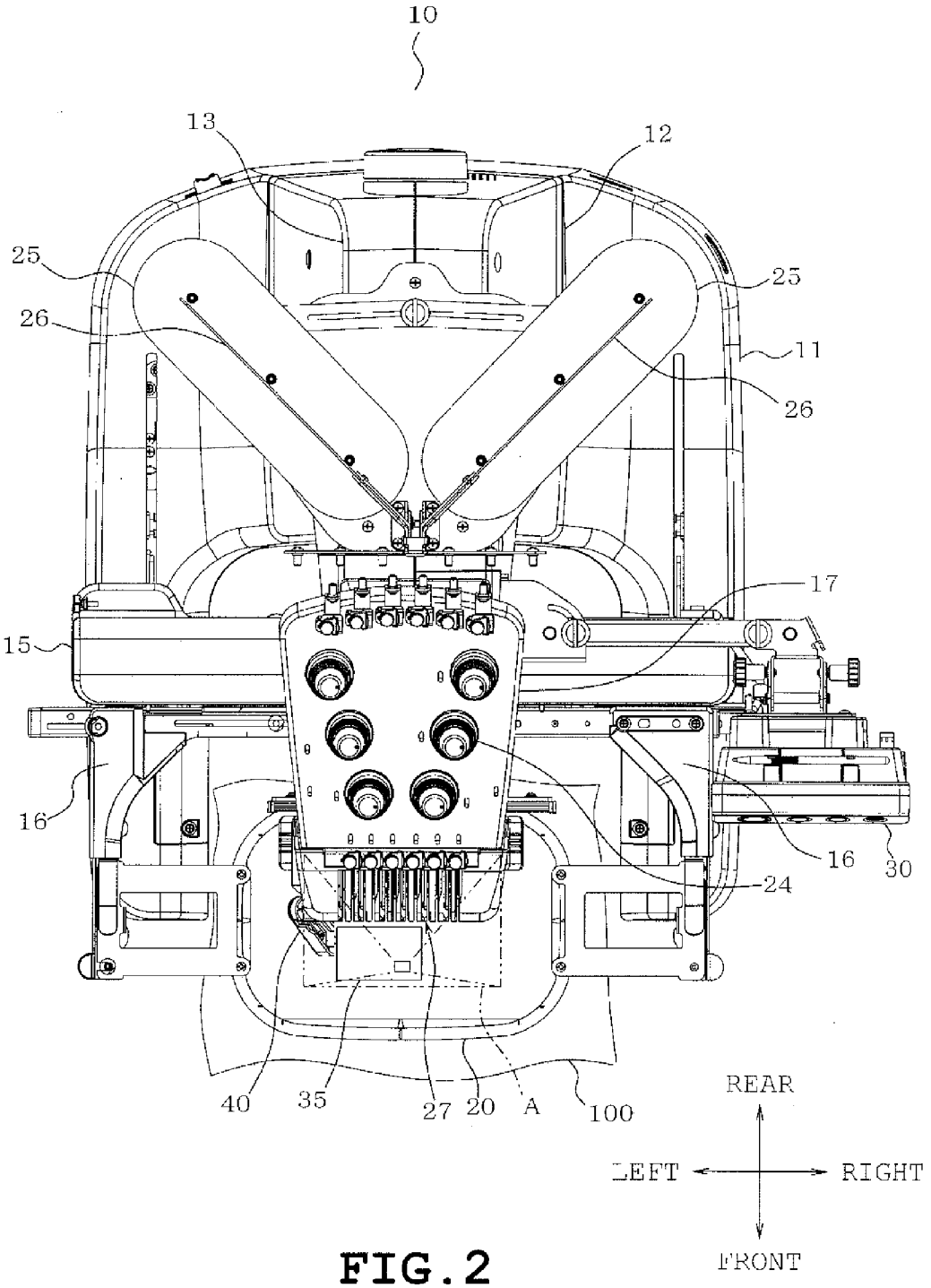
FIG. 2 is a plan view of the multi-needle sewing machine.
Figure 3:
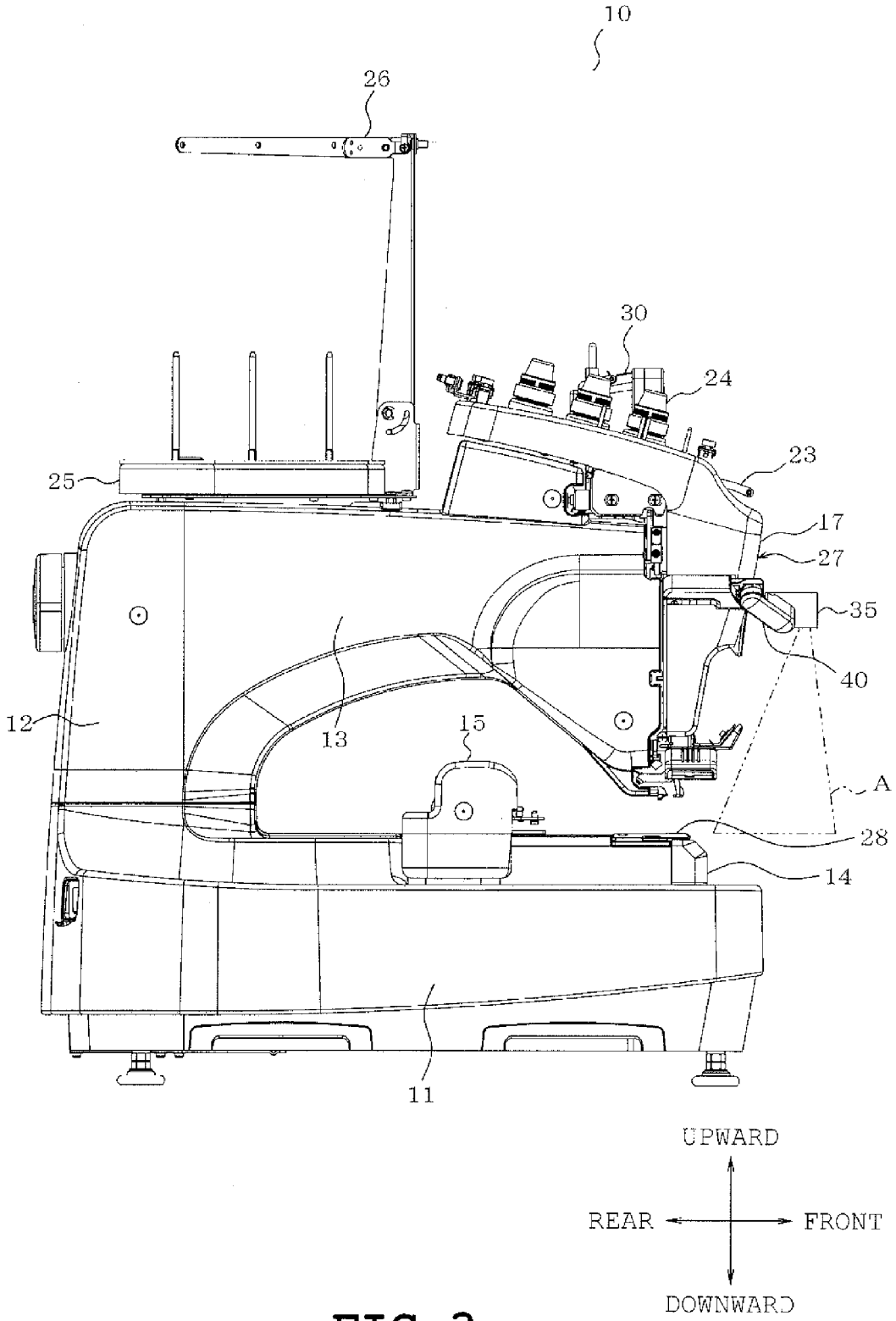
FIG. 3 is a left side view of the multi-needle sewing machine.

A multi-needle sewing machine 10 according to a first embodiment will be described with reference to FIGS. 1 to 7B. Referring to FIGS. 1 to 3, the multi-needle sewing machine 10 includes six needle bars (see FIG. 5A), a pair of right and left legs 11, a pillar 12, an arm 13, a cylinder bed 14, a carriage 15, a frame mount 16 and a needle bar case 17. Referring to FIGS. 2 and 3, the side where a user is located relative to the sewing machine M will be referred to as "front" and the side opposed to the front will be referred to as "rear." A horizontal direction in FIGS. 1 and 2 corresponds to a right-left direction of the multi-needle sewing machine 10. A vertical direction in FIGS. 1 and 3 corresponds to an up-down direction of the multi-needle sewing machine 10.

The legs 11 support the entire multi-needle sewing machine 10. The pillar 12 extends upward from rear ends of the legs 11. The arm 13 extends frontward from an upper part of the pillar 12. The cylinder bed 14 extends frontward from a lower end of the pillar 12. The carriage 15 is mounted on upper surfaces of the legs 11 thereby to extend in the right-left direction. The frame mount 16 is mounted on a front of the carriage 15.

The carriage 15 is moved in a Y-axis direction (a front-back direction) by a Y-axis drive mechanism (not shown) provided inside the legs 11. The Y-axis drive mechanism is driven by a Y-axis motor 19 (see FIG. 4). The frame mount 16 is moved in an X-axis direction (the right-left direction) by an X-axis drive mechanism (not shown) provided inside the carriage 15. The X-axis drive mechanism is driven by an X-axis motor 18 (see FIG. 4).

A workpiece cloth 100 on which an embroidery pattern is to be sewn is held by a generally rectangular embroidery frame 20, which is further attached to the frame mount 16, as shown in FIG. 2. The workpiece cloth 100 is thus moved in the X-axis direction together with the frame mount 16 by the X-axis drive mechanism and in the Y-axis direction together with the carriage 15 by the Y-axis drive mechanism, while being held by the embroidery frame 20.

The needle bar case 17 supports six needle bars 21 so that the needle bars 21 are movable upward and downward. The needle bars 21 are arranged in the right-left direction and extend in the up-down direction. The needle bars 21 have lower ends to which needles 22 are mounted respectively. Further, the needle bar case 17 has six thread take-up levers 23 and six thread tension completes 24. The thread take-up levers 23 are mounted on a front upper part of the needle bar case 17 and arranged in the right-left direction so as to correspond to the needle bars 21 respectively. The thread take-up levers 23 are configured to be movable upward and downward in synchronization with the upward and downward movement of the respective needle bars 21. The thread tension completes 24 are fixed to an upper end of the needle bar case 17 to adjust thread tensions of needle threads respectively.

The multi-needle sewing machine 10 further includes a pair of right and left spool holder bases 25 and a pair of right and left thread guide mechanisms 26. The spool holder bases 25 and the thread guide mechanisms 26 are provided on an upper rear of the arm 13 so as to be located in the rear of the thread tension completes 24. Thread spools (not shown) on which threads (hereinafter, "needle threads") are wound are placed on the spool holder bases 25. Three thread spools can be placed on each spool holder base 25 and in total, six thread spools can be placed. The thread spools are arranged in a lengthwise direction of the spool holder bases 25. The needle threads wound on the thread spools have thread colors differing from one another. The needle threads drawn out of the thread spools are supplied through the thread guide mechanisms 26, the thread tension completes 24 and the thread take-up levers 23 to eyes (not shown) of the corresponding needles 22 respectively. A path of the needle threads thus extends from the thread spools mounted on the spool holder bases 25 to the eyes of the needles 22. The needle thread path includes narrow grooves which are provided at the front side of the needle bar case 17 (at the user's side) so as to extend in the up-down direction. The narrow groove defines a thread supply path 27 along which the needle threads pass.

The cylinder bed 14 has a needle plate 28 which is mounted on an upper surface thereof and formed with a through needle hole (not shown). Each one of the needles 22 attached to the respective needle bars 21 is insertable through the needle hole. The location of the needle bar 21 in the case where each needle 22 is located directly above the needle hole of the needle plate 28 will be referred to as "needle location." A rotation shuttle (not shown) is provided below the needle plate 28 inside the cylinder bed 14. A bobbin on which a bobbin thread is wound is attached to the rotation shuttle although not shown.

A needle bar selecting mechanism (not shown) is provided inside the arm 13. The needle bar selecting mechanism moves the needle bar case 17 in the right-left direction thereby to move any one of the six needle bars 21 to the needle location. Thus, one of the needle bars 21 is alternatively selected, so that the thread color of needle thread for the embroidery pattern to be sewn on the workpiece cloth 100 is changed from one to another. The needle bar 21 located at the needle location is moved upward and downward together with the corresponding thread take-up lever 23 by a sewing machine motor 29 (see FIG. 4). The embroidery pattern (not shown) is sewn on the workpiece cloth 100 held by the embroidery frame 20 in cooperation of the needle bars 21, the thread take-up levers 23 and the rotation shuttle.

Figure 4:
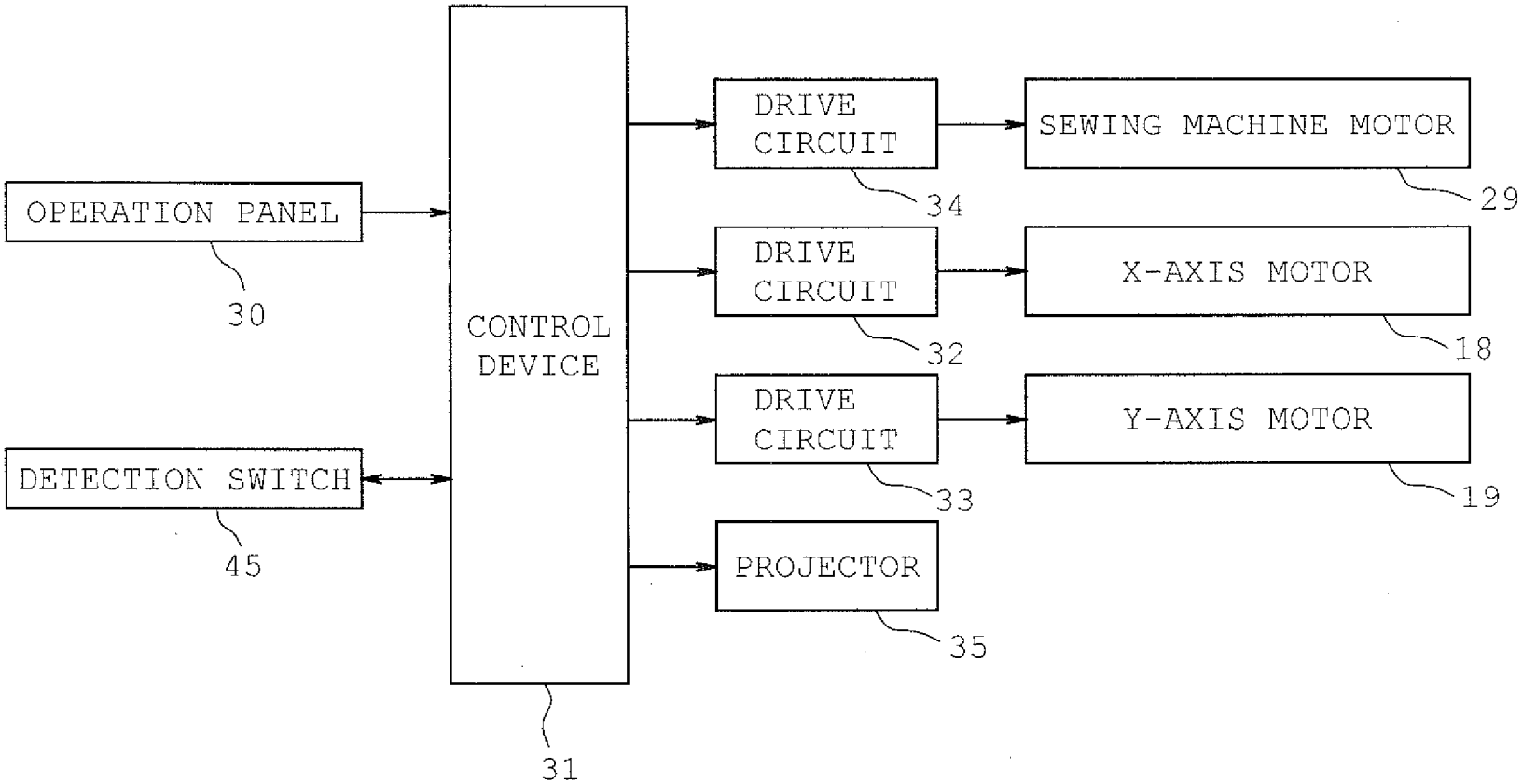
FIG. 4 is a block diagram schematically showing an electrical arrangement of the multi-needle sewing machine.

The multi-needle sewing machine 10 includes an operation panel 30 and a control device 31 as shown in FIG. 4. The operation panel 30 is mounted on the right of the arm 13 as shown in FIGS. 1 and 2. The operation panel 30 includes a liquid crystal display having a touch panel on a front, thereby serving as an operation input unit and a display unit. The operation panel 30 displays various embroidery patterns, thread information about needle threads set according to the respective needle bars, sewing conditions of thread tension, sewing speeds and the like, various names of functions required for a sewing work, various pieces of information about sewing, and the like. Touch keys displayed on the operation panel 30 are operated by finger touch or the like for the user to instruct various functions or the like or to set various sewing parameters and thread change.

The control device 31 is configured of a microcomputer having a CPU, a ROM, a RAM and the like none of which are shown. The control device 31 is connected to the operation panel 30 and drive circuits 32, 33 and 34 for motor control. The drive circuit 32 is connected to the X-axis motor 18 to control drive of the X-axis motor 18. The drive circuit 33 is connected to the Y-axis motor 19 to control drive of the Y-axis motor 19. The drive circuit 34 is connected to the sewing machine motor 29 to control drive of the sewing machine motor 29.

The multi-needle sewing machine 10 further includes a projector 35. The projector 35 is a known image projector and for example, an image projector using a liquid crystal panel or a digital image projector using a microscopic mirror display device such as DLP (registered trademark owned by Texas Instruments). The projector 35 is supported by a support device 40 as shown in FIGS. 1 to 3. The support device 40 is mounted on the needle bar case 17. The projector 35 is connected to the control device 31 thereby to be controlled by the control device 31 as shown in FIG. 4. The projector 35 projects an image onto the workpiece cloth 100 from above the embroidery frame 20 as shown by alternate long and two short dashes lines in FIGS. 1 to 3. A cable connecting between the projector 35 and the control device 31 is not shown. Further, the embroidery frame 20 is not shown in FIG. 3 for the sake of easiness in illustration. The control device 31 functions as a control unit which controls image projection by the projector 35. Reference symbol A in each of FIGS. 1 to 3, 5A and 5B designates a projection range of the projector 35 shown by the alternate long and two short dashes lines.

The support device 40 is configured to be capable of switching the projector 35 between a first position where the projector 35 projects an image onto the workpiece cloth 100 and a second position differing from the first position. When located at the first position, the projector 35 covers at least a part of the thread supply path 27, that is, the projector 35 is located at the front side of the thread supply path 27 located at the front side of the needle bar case 17, as shown by solid line in FIG. 5. Further, the projector 35 is situated above the embroidery frame 20 when located at the first position, as shown in FIGS. 1, 2, 5A and 5B.

Figure 5A:
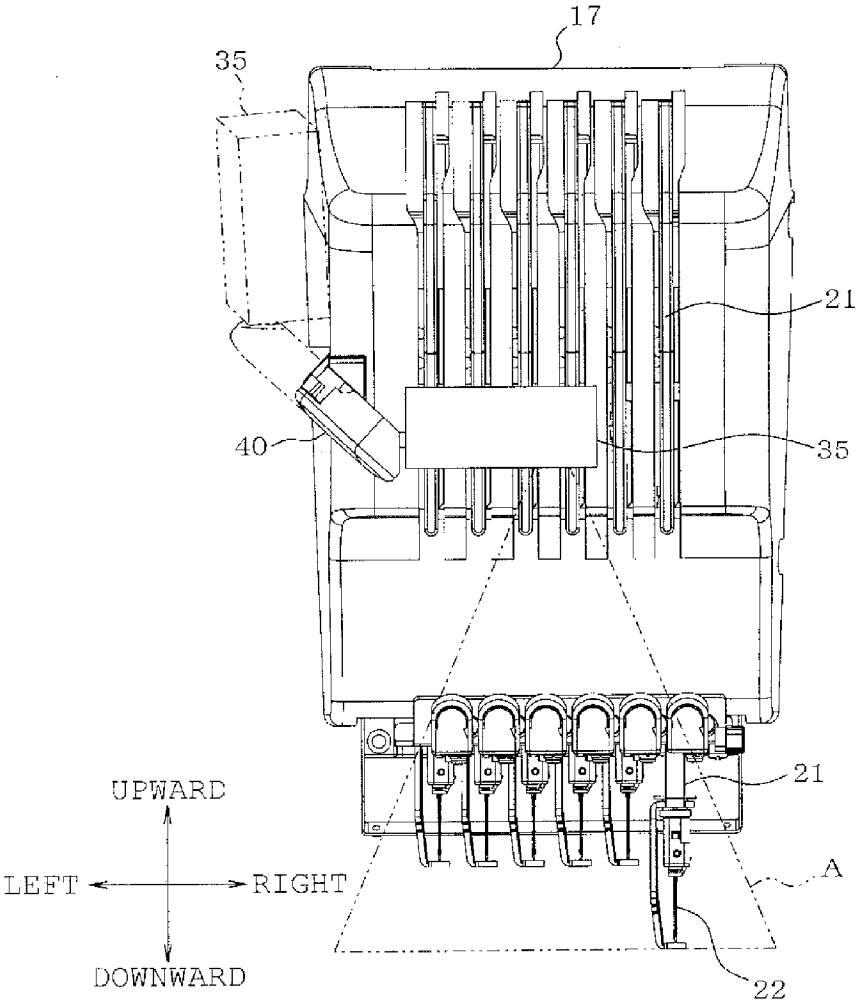
FIGS. 5A and 5B are a front view and a left side view of a support device and a needle bar case respectively.
Figure 5B:
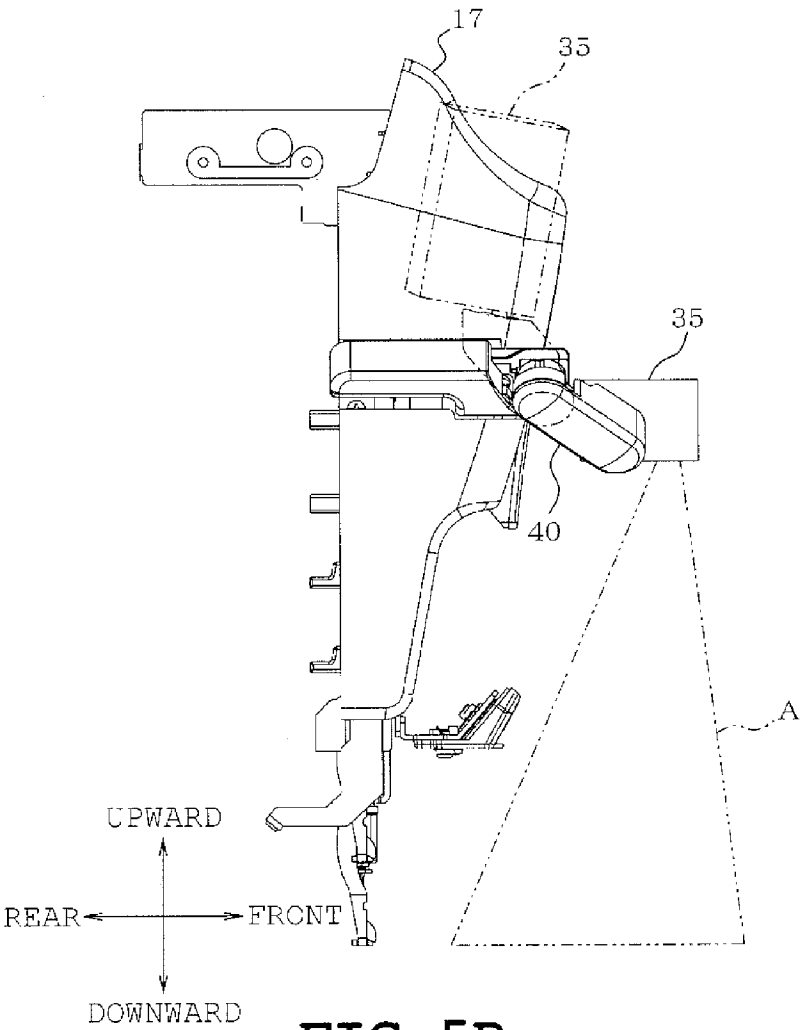

When the projector 35 is located at the second position, the thread supply path 27 is open without the projector 35 covering the thread supply path 27 as shown by the alternate long and two short dashes lines in FIGS. 5A and 5B, that is, the projector 35 is lateral to the needle bar case 17 and the thread supply path is open at the front side thereof. In other words, the second position differs from the first position, and the projector 35 is lateral (left lateral) to the needle bar case 17 when located at the second position.

Figure 6A:
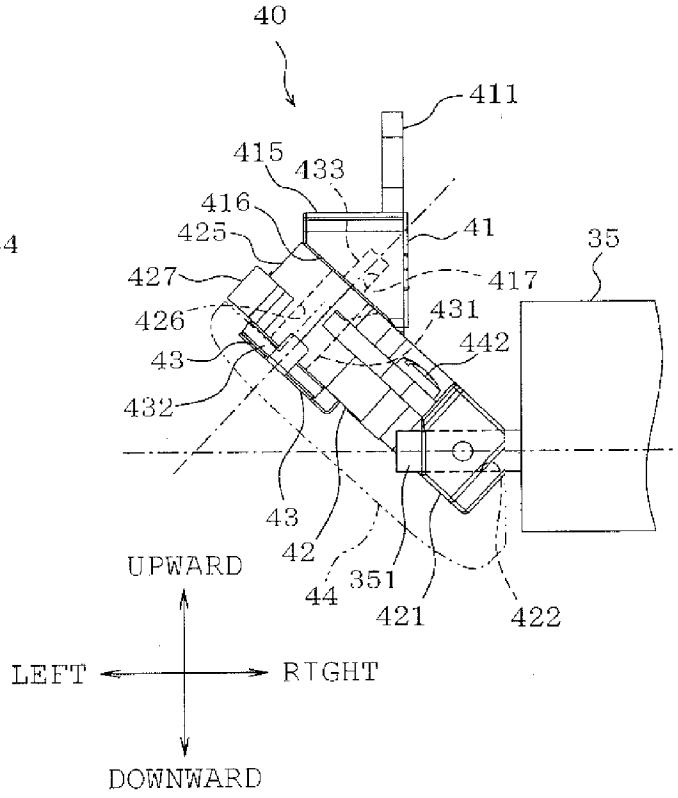
FIGS. 6A and 6B are a front view and a left side view of the support device located at a first position respectively.
Figure 6B:
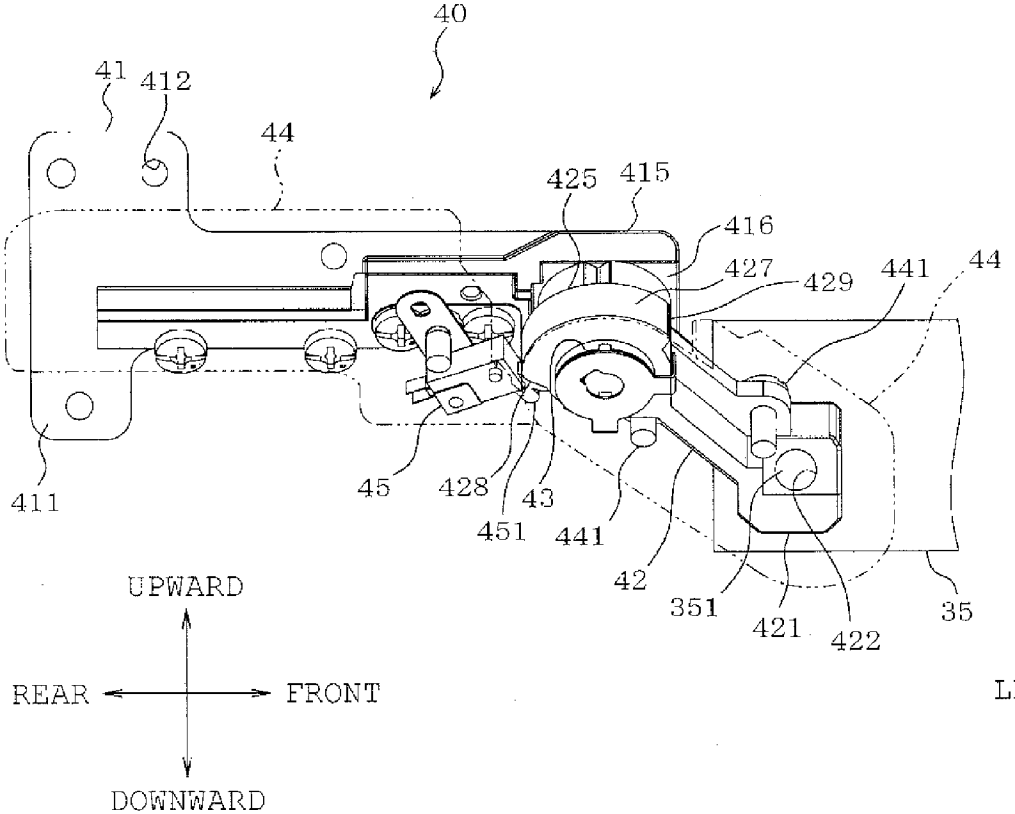
Figure 7A:
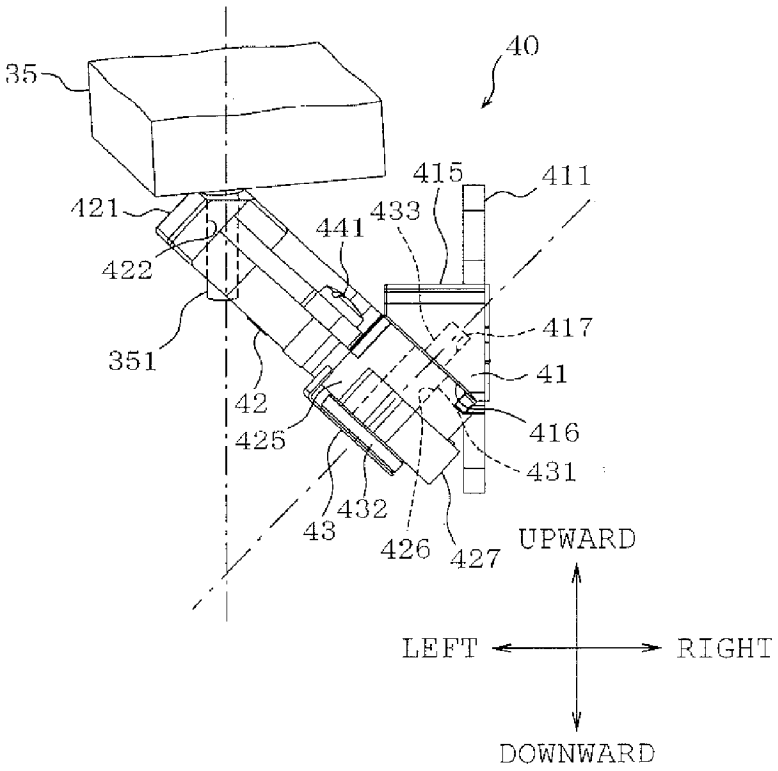
FIGS. 7A and 7B are a front view and a left side view of the support device located at a second position respectively.
Figure 7B:
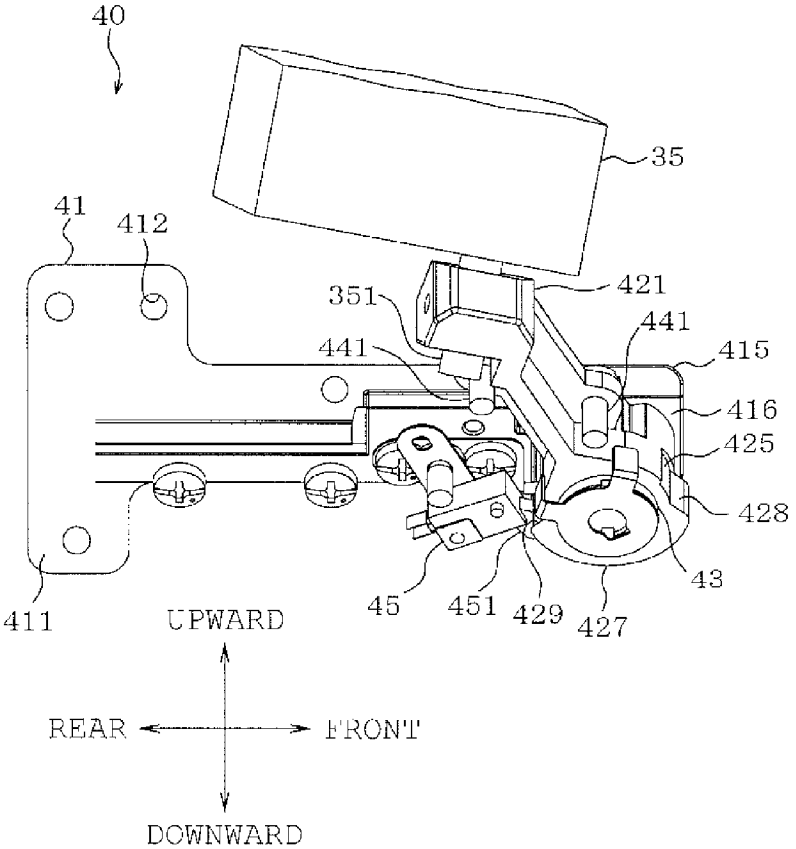

The support device 40 includes a base member 41, a support member 42 a shaft member 43, a cover 44 and a detection switch 45 as shown in FIGS. GA to 7B. FIGS. GA to 7B each show only a part of the projector 35 for the sake of easiness in illustration. FIGS. 6A and 6B show the case where the projector 35 is located at the first position and FIGS. 7A and 7B show the case where the projector 35 is located at the second position. The base member 41 has a mounting part 411 and a bearing 415 both of which are formed integrally therewith. The mounting part 411 is formed into a plate shape and has a plurality of through holes 412. Screws (not shown) are inserted through the respective holes 412 and screwed into a side of the needle bar case 17. As a result, the base member 41 are fixed to the side or more specifically, the left side of the needle bar case 17.

The bearing 415 is formed into a block shape and provided in front of the mounting part 411. The bearing 415 has a mounting surface 416 and a screw hole 417. The mounting surface 416 is formed into an inclined surface which is inclined at a predetermined angle (45°, for example) to a surface of the mounting part 411 and inclined rightwardly downward as viewed at the front. The screw hole 417 is formed in the direction orthogonal to the mounting surface 416.

The support member 42 has a distal end 421 and a proximal end 425. The distal end 421 is formed with a through hole 422. The hole 422 extends in the right-left direction when the support member 42 is situated as shown in FIG. 6A. A support shaft 351 extending from a left end of the projector 35 is fitted into the hole 422 thereby to be fixed by a screw (not shown). As a result, the projector 35 is mounted on the distal end of the support member 42. The proximal end 425 is formed with an insertion hole 426 into which the shaft member 43 is to be inserted as will be described later.

The shaft member 43 has a shaft part 431, a head 432 and a male thread 433. The shaft part 431 is formed into a columnar shape and is rotatably fitted into the insertion hole of the support member 42. The shaft 431 has a length that is slightly larger than a depth (a length) of the insertion hole 426. The head 432 is disposed on a distal end of the shaft part 431 and is larger than a diameter of the shaft part 431. The male thread 433 is formed on a distal end of the shaft part 431 and is smaller than a diameter of the shaft part 431.

The shaft member 43 is inserted through the insertion hole 426 and the male thread 433 thereof is then screwed into the screw hole 417 of the base member 41, whereby the shaft member 43 is fixed in position. As a result, the support member 42 is swung about the shaft member 43. More specifically, the support member 42 is swingably supported by the shaft member 43. The shaft member 43 has a central axis line extending in the direction of 45° with rightwardly upward inclination as viewed at the front.

The cover 44 is made of a resin and covers the support member 42. The cover 44 is attached to the support member 42 by a screw 441 although an attaching manner is not shown in detail. Further, the support member 42 has a cam 427 as shown in FIGS. 6B and 7B. The cam 427 is provided on an outer periphery of the proximal end 425 of the support member 42 and formed into the shape of a sector concentric with the hole 422. The cam 427 has a first end 428 and a second end 429.

The support device 40 has a limiting part (not shown) which limits a swinging range of the support member 42. The limiting part limits the support member 42 to a swinging range between a position (corresponding to one end of the swinging range) as shown in FIGS. 6A and 6B and another position (corresponding to the other end of the swinging range) as shown in FIGS. 7A and 7B in the embodiment.

The support device 40 has a position holding mechanism which is not shown. When the support member 42 is located at the position as shown in FIGS. 6A and 6B or the position as shown in 7A and 7B, the position holding mechanism holds the position of the support member 42 by a relatively weaker holding force. Accordingly, when located at the first or second position, the projector 35 is held at the position by the position holding mechanism. An external force exceeding the holding force of the position holding mechanism is applied to the projector 35 when the user operates to switch the position of the projector 35.

The detection switch 45 is comprised of a microswitch capable of detecting two positions, for example, and has a swingable lever 451. The detection switch 45 has a first contact and a second contact internally. The first and second contacts are switched between ON and OFF according to a swing angle of the lever 451. More specifically, when the swing angle of the lever 451 is equal to a predetermined first angle, the first contact is switched to ON and the second contact is switched to OFF. When the swing angle of the lever 451 is equal to a predetermined second angle, the first contact is switched to OFF and the second contact is switched to ON. When the swing angle of the lever 451 is equal to a predetermined third angle, both first and second contacts are switched to OFF. A lead wire connecting between the detection switch 45 and the control device 31 is eliminated in the drawing.

The lever 451 is brought into contact with the cam 427. When the support member 42 is located at the position as shown in FIGS. 6A and 6B, the lever 451 is brought into contact with the first end 428 thereby to be placed at the first angle. In this case, the first contact of the detection switch 45 is switched to ON and the second contact thereof is switched to OFF. Further, when the support member 42 is located at the position as shown in FIGS. 7A and 7B, the lever 451 is brought into contact with the second end 429 thereby to be placed at the second angle. In this case, the first contact of the detection switch 45 is switched to OFF and the second contact thereof is switched to ON. Still further, when the support member 42 is located between the position as shown in FIGS. 6A and 6B and the position as shown in FIGS. 7A and 7B, the lever 451 is brought into contact with a part of the cam 427 located between the first and second ends 428 and 429 thereby to be placed at the third angle, so that both first and second contacts are switched to OFF. The detection switch 45 detects the position of the support member 42 in the manner as described above with the result that the position of the projector 35 is detected.

The detection switch 45 is connected to the control device 31 to supply results of detection, that is, ON or OFF of the contacts to the control device 31, as shown in. FIG. 4. Based on the results of detection of the detection switch 45, the control device 31 determines at which one of the first and second positions the projector 35 is located. When the projector 35 is located at the first position, the control device 31 controls the projector 35 so that an image is projected. The detection switch 45 should not be limited to the above-described microswitch but may be comprised of an optical sensor or a magnetic sensor, for example.

When the first contact of the detection switch 45 is ON, that is, when the first contact is ON and the second contact is OFF, the control device 31 determines that the projector 35 is located at the first position, allowing the projector 35 to project an image. Further, when the first contact is OFF, that is, when the first contact is OFF and the second contact is ON, the control device 31 determines that the projector 35 is located at the second position, controlling the projector 35 so that no image is projected.

When both first and second contacts of the detection switch 45 are OFF, the control device 31 may determine that the projector 35 is not located either at the first position or at the second position, controlling the projector 35 so that no image is projected. In this case, the control device 31 may control the sewing machine motor 29, the needle bar selecting mechanism, the X-axis moving mechanism and the Y-axis moving mechanism so that the motor and these mechanisms are not driven.

According to the foregoing embodiment, the support device 40 supporting the projector 35 is configured to be capable of switching between the first position and the second position. More specifically, the support device 40 is configured to be capable of switching the projector 35 between the first position where an image is projected onto the workpiece cloth and the second position differing from the first position. Accordingly, when located at the first position, the projector 35 is allowed to project onto the workpiece cloth 100 an image of embroidery pattern assuming sewing finish, as shown by the alternate long and two short dashes lines in FIGS. 1 to 3.

Further, when located at the first position, the projector 35 covers at least a part of the thread supply path 27, that is, the projector 35 covers the thread supply path 27 provided at the front side of the needle bar case 17. On the other hand, when located at the second position, the thread supply path 27 is open without the projector 35 covering the thread supply path 27, as shown by the alternate long and two short dashes lines in FIGS. 5A and 5B, that is, the projector 35 is lateral to the needle bar case 17 and the thread supply path is open at the front side thereof. Accordingly, the user can smoothly set the needle thread along the thread supply path 27 without the projector 35 getting in the way of user's work, by switching the projector 35 from the first position to the second position.

The support member 42 of the support device 40 is configured to be capable of swinging with the shaft member 43 of the needle bar case 17 serving as the fulcrum. The position of the support member 42 as shown in FIGS. 6A and 6B represents the one end of the swinging range and the position of the support member 42 as shown in FIGS. 7A and 7B represents the other end. Further, since the support device 40 is provided in the needle bar case 17, the support device 40 can be rendered small-sized.

The shaft member 43 serving as the fulcrum of the support device 40 has the central axis line extending in the direction of 45° with rightwardly upward inclination as viewed at the front. Accordingly, when the support member 42 of the support device 40 is located at the one end of the swinging range, that is, when located at the first position, the projector 35 is postured such that the lengthwise direction thereof corresponds to the right-left direction of the multi-needle sewing machine 10, as shown in FIGS. 5A and 5B. Further, when the support member 42 is located at the other end of the swinging range, that is, when located at the second position, the projector 35 is postured such that the lengthwise direction thereof corresponds to the up-down direction of the multi-needle sewing machine 10 along the side surface of the needle bar case 17. Accordingly, the projector 35 can be prevented from protruding laterally of the needle bar case 17 to a large extent when located at the second position.

The detection switch 45 detects the swinging position of the support member 42, thereby detecting the first or second position of the projector 35. When the projector 35 is located at the first position, the control device 31 determines that an image can be projected. When the projector 35 is located at the second position, the control device 31 controls the projector so that no image is projected. According to this configuration, since an image is projected only when the projector 35 is located at the first position, an image can be projected to the workpiece cloth 100 in an optimum manner.

Figure 8:
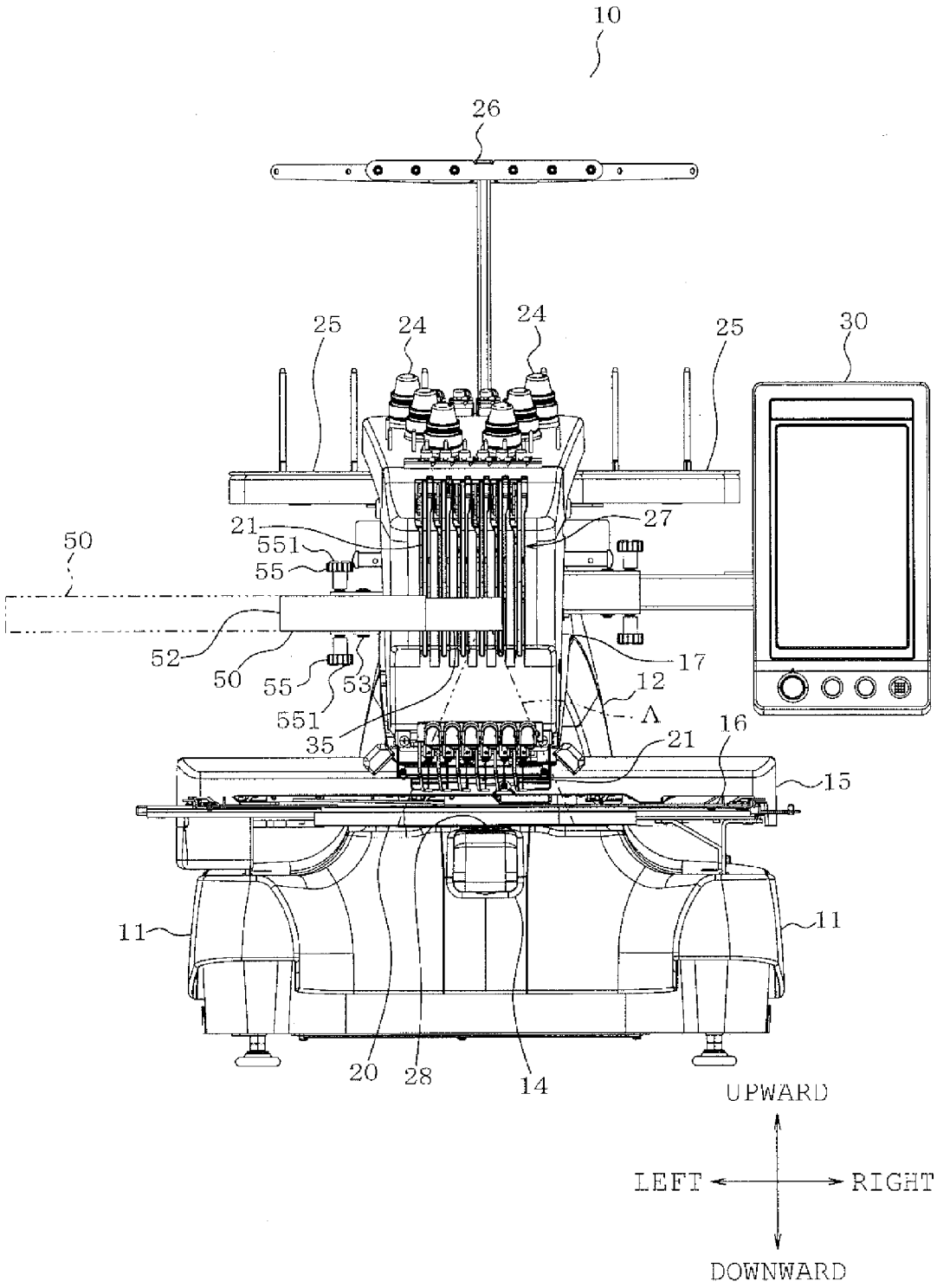
FIG. 8 is a front view of the multi-needle sewing machine according to a second embodiment.
Figure 9:
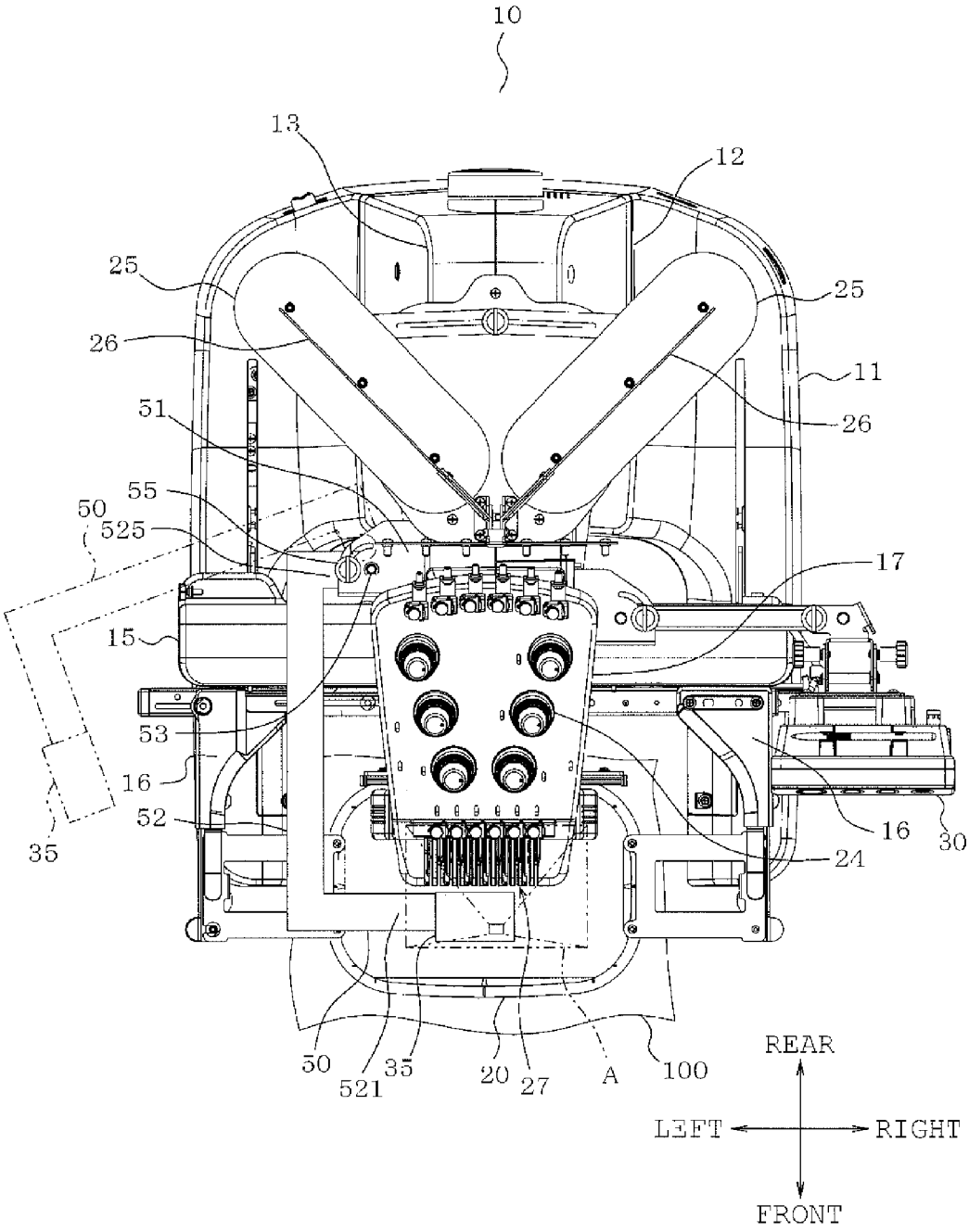
FIG. 9 is a plan view of the multi-needle sewing machine according to the second embodiment.

A second embodiment will be described with reference to FIGS. 8 to 10B. In the second embodiment, the multi-needle sewing machine 10 includes a support device 50, instead of the support device 40 in the first embodiment. The support device 50 is configured to be capable of switching the projector 35 between the first position where an image is projected onto the workpiece cloth 100 and the second position differing from the first position in the same manner as the support device 40 in the first embodiment. In FIGS. 8 and 9, the solid line shows a case where the projector 35 and the support device 50 are located at the first position, and the alternate long and two short dashes line shows a case where the projector 35 and the support device 50 are located at the second position.

Figure 10A:
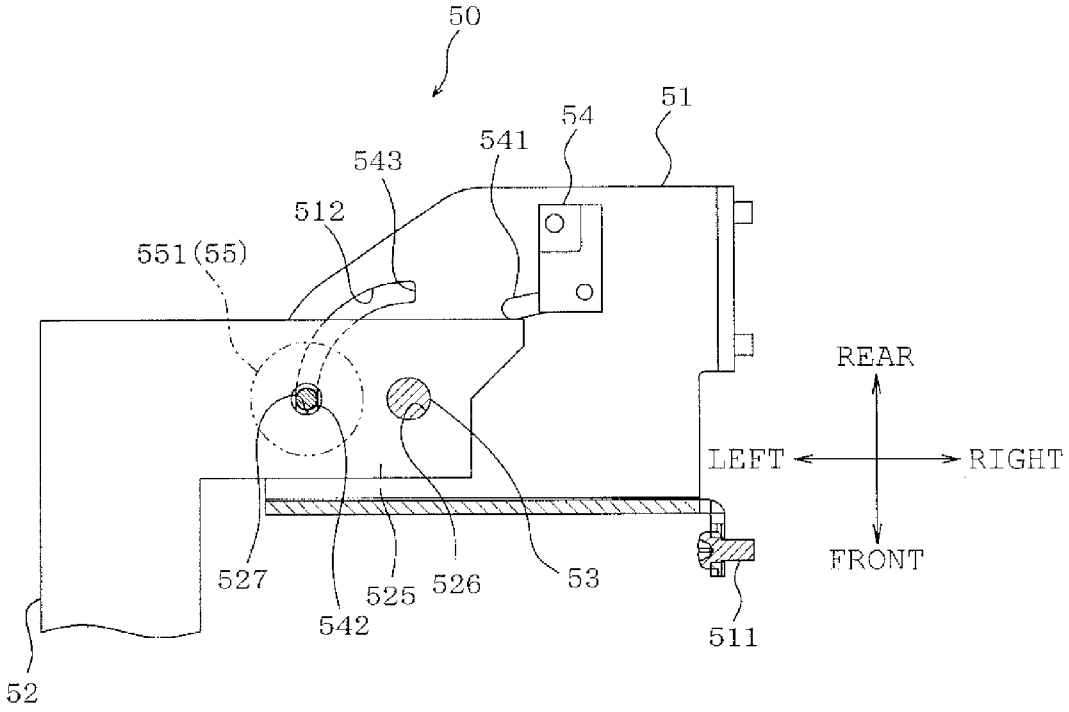
FIGS. 10A and 10B are plan views of a proximal end of the support device, showing the first and second positions respectively.
Figure 10B:
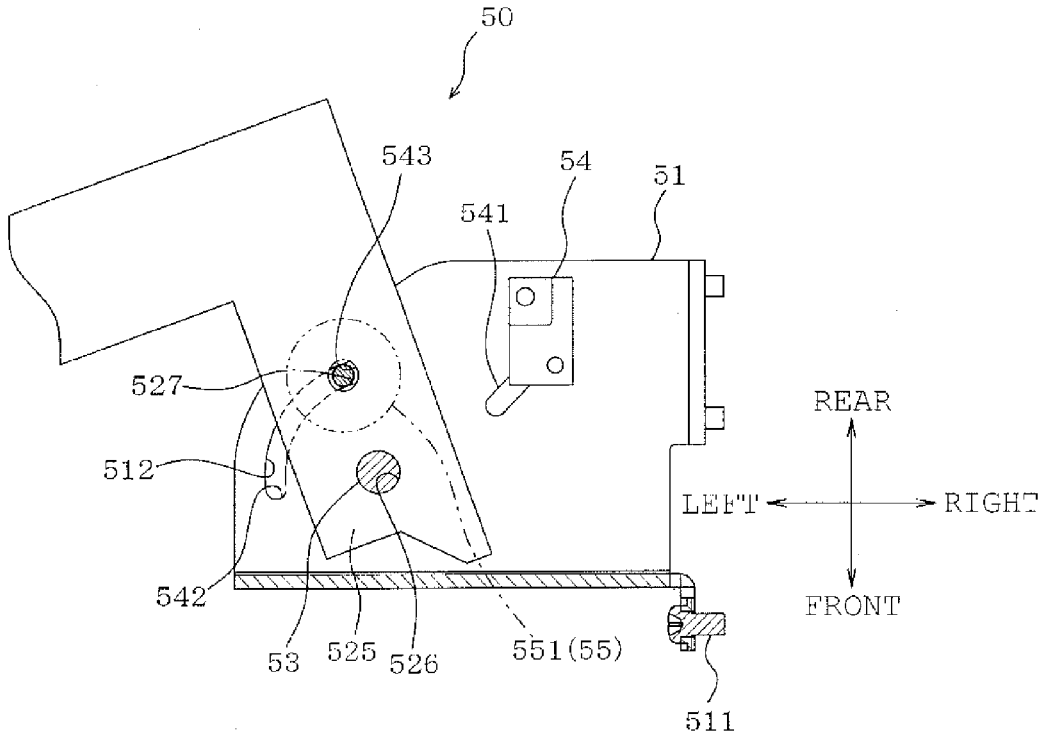

The support device 50 is left lateral to the arm 13 and has a mounting member 51, the support member 52, the shaft member 53, the detection switch 54 and the screw member 55. The mounting member 51 is formed by folding a metal plate into a laterally-facing U-shape as viewed in a left side elevation, for example. The mounting member 51 is shaped to sandwich the proximal portion 525 of the support member 52 which will be described later. The mounting member 51 has a through hole which vertically extends therethrough and through which the shaft member 53 is inserted as will be described later, as shown in FIGS. 9, 10A and 10B. The mounting member 51 also has an arc-shaped elongate hole 512 vertically extending therethrough as shown in FIGS. 10A and 10B. The mounting member 51 is fixed to the left side of the arm 13 by a screw 511 while being mounted with the support member 52, the shaft member 53 and the detection switch 54. A lead wire connecting between the detection switch 54 and the control device 31 is eliminated in the drawing.

The support member 52 is formed by folding a square bar into a laterally-facing U-shape with an open right side as viewed in a plan view. The support member 52 has a distal end 521 and a proximal end 525. The projector 35 is mounted on the distal end 521. The support member 52 is formed into such a shape as not to interfere with needle bar case 17 even when the needle bar case 17 is moved in the right-left direction while the projector 35 and the support member 52 are located at the first position.

The support member 52 has a through hole 526 and a female screw hole 527 both extending through the proximal end 525 thereof in the up-down direction as shown in FIGS. 10A and 10B. The shaft member 53 is inserted through the hole 526 to be retained on the mounting member 51 by two retaining rings (not shown). As a result, the support member 52 is swingable with the shaft member 53 serving as a fulcrum.

The elongate hole 512 is formed into the shape of an arc about the shaft member 53. A distance between centers of the shaft member 53 and the elongate hole 512 is equal to a distance between centers of the hole 526 and the female screw hole 527. Further, the elongate hole 512 has a width that is slightly larger than a diameter of the female screw hole 527. Accordingly, the female screw hole 527 is retained in the elongate hole 512 even when the support member 52 is swung about the shaft member 53.

The screw members 55 have knobs 551 which are knurled, for example and male screws (not shown) respectively as shown in FIG. 8. Each knob 551 has an outline that is larger than the width of the elongate hole 512. The male screws of the screw members 55 are passed through the elongate hole 512 from the up-down direction to be screwed into the female screw hole 527. As a result, the support member 52 is fixed at a desired position.

A swinging range of the support member 52 is determined depending upon a start end 542 and a terminal end 543 of the elongate hole 512. More specifically, the male screw (a root portion of the male screw passed through the female screw hole 527 of the support member 52) of each screw member 55 abuts against the first end 542 of the elongate hole 512. The position of the male screw in this case serves as an end of the swinging range of the support member 52. Further, the male screw (the root portion of the male screw passed through the female screw hole 527 of the support member 52) of each screw member 55 abuts against the second end 543 of the elongate hole 512. The position of the male screw in this case serves as the other end of the swinging range of the support member 52. The projector 35 is located at the first position when the support member 52 is located at the one end of the swinging range. The projector 35 is located at the second position when the support member 52 is located at the other end of the swinging range.

The detection switch 54 is comprised of a microswitch, for example and has a swingable lever 541. The detection switch 54 is mounted on an upper surface of the lower part of the mounting member 51. When the lever 541 is pressed, a contact (not shown) of the detection switch 54 is switched from OFF to ON. In this case, when the lever 541 is pressed by the support member 52, that is, when the projector 35 and the support member 52 are located at the first position, the contact is switched to ON. On the other hand, the contact of the detection switch 54 is switched to OFF when the lever 541 is not pressed by the support member, that is, when the projector 35 and the support member 52 are located at the second position, as shown in FIG. 10B.

Consequently, when the contact of the detection switch 54 is switched to ON, the control device 31 determines that the projector 35 is located at the first position, allowing the projector 35 to project an image. Further, when the contact of the detection switch 54 is switched to OFF, the control device 31 determines that the projector 35 is located at the second position, thereby disallowing image projection by the projector 35.

According to the above-described construction, the second embodiment can achieve the same working and effects as the first embodiment. Further, since the support member 52 (the support device 50) is disposed on the left of the needle bar case 17 and the operation panel 30 is disposed on the right of the needle bar case 17, the support member 52 never gets in the way when the user operates the operation panel 30.

Further, since the support device 440 supporting the projector 35 is mounted on the needle bar case 17 in the first embodiment, the position of the projector 35 in the right-left direction or the projection position of an image in the right-left direction by the projector 35 is changed depending upon the position of the needle bar case 17 in the right-left direction. However, since the support member 52 (the support device 50) is mounted on the arm 13 in the second embodiment, the image projection position of the projector 35 can be can be set at a predetermined position irrespective of the position of the needle bar case 17 in the right-left direction.

FIGS. 11 to 14B illustrate a third embodiment. In the third embodiment, the multi-needle sewing machine 10 includes a support device 60, instead of the support device 40 or 50. The support device 60 is configured to be detachably attachable to the needle bar case 17. As a result, the support device 60 is also switchable between the first position where an image is projected onto the workpiece cloth 100 and the second position differing from the first position in the same manner as the support device 40 or 50 in the foregoing embodiment. In this case, the position of the support device 60 mounted on the needle bar case 17 is a first position, and the position of the support device 60 detached from the needle bar case 17 is a second position. A position on a work table (not shown) on which the multi-needle sewing machine 10 is mounted is a specific example of the second position.

Figure 13A:
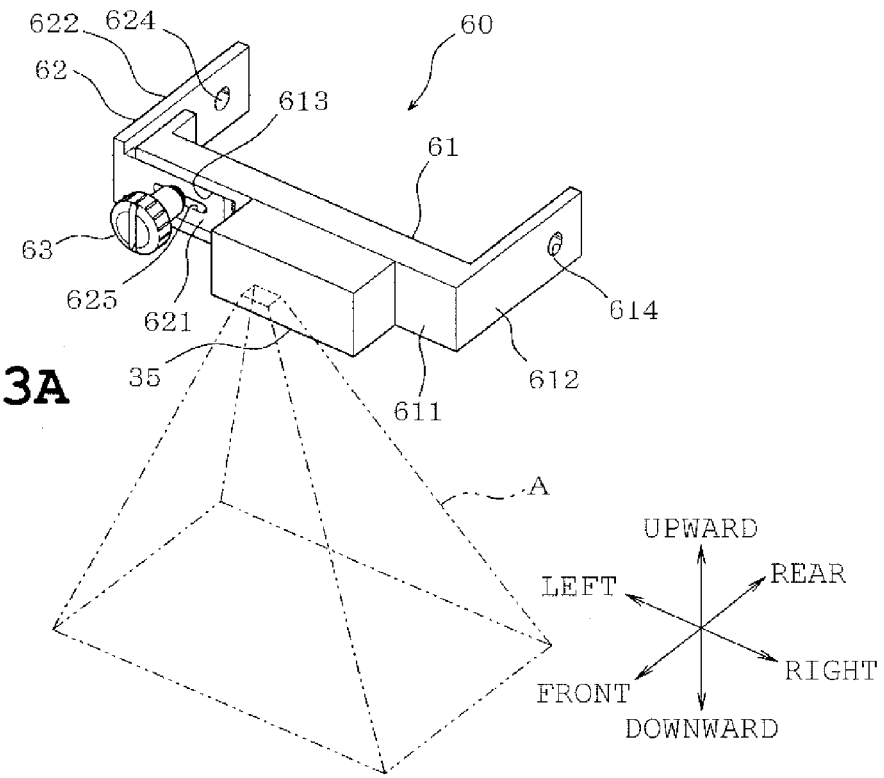
FIGS. 13A and 13B are perspective views of the support device, showing the cases where the support device is attached and detached respectively.
Figure 13B:
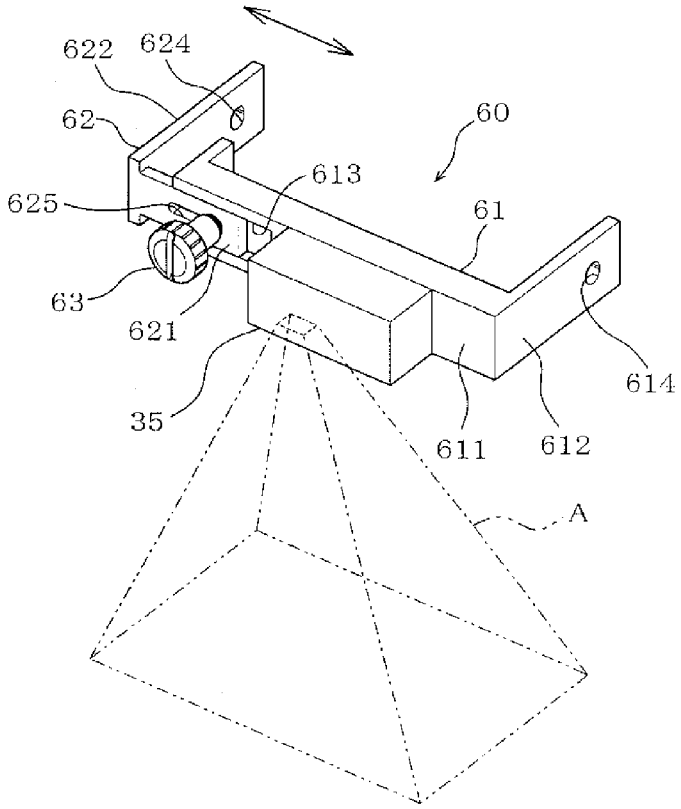

The support device 60 includes a first support member 61, a second support member 62 and a screw member 63 as shown in FIGS. 13A and 13B. The screw member 63 is constructed in the same manner as the screw member 55 in the second embodiment. The first support member 61 has a front 611 and a right side 612 and is formed into an L-shape as viewed in a plan view, as shown in FIGS. 13A and 13B. The second support member 62 has a front 621 and a left side 622 and is formed into an L-shape. The first and second support members 61 and 62 are combined together into a U-shape having an open needle bar case 17 side or rear side and two substantially right-angled corners. The projector 35 is fixed to the front 611 of the first support member 61.

The front 611 of the first support member 61 has a distal end, namely, a left end formed with a groove 613 and a female screw hole (not shown) located inside the groove 613. The front 621 of the second support member 62 is constructed to fit into the groove 613. The second support member 62 is moved along the groove 613 in the right-left direction with the front 621 thereof being fitted into the groove 613. The front 621 of the second support member 62 is formed with an elongate hole 625 having a width that is slightly larger than a diameter of the female screw hole, so that the female screw hole is retained in the elongate hole 625 even when the second support member 62 is moved in the right-left direction. The second support member 62 is fixed to the first support member 61 by screwing a male screw (not shown) of the screw member 63 into the female screw hole.

Figure 14A:
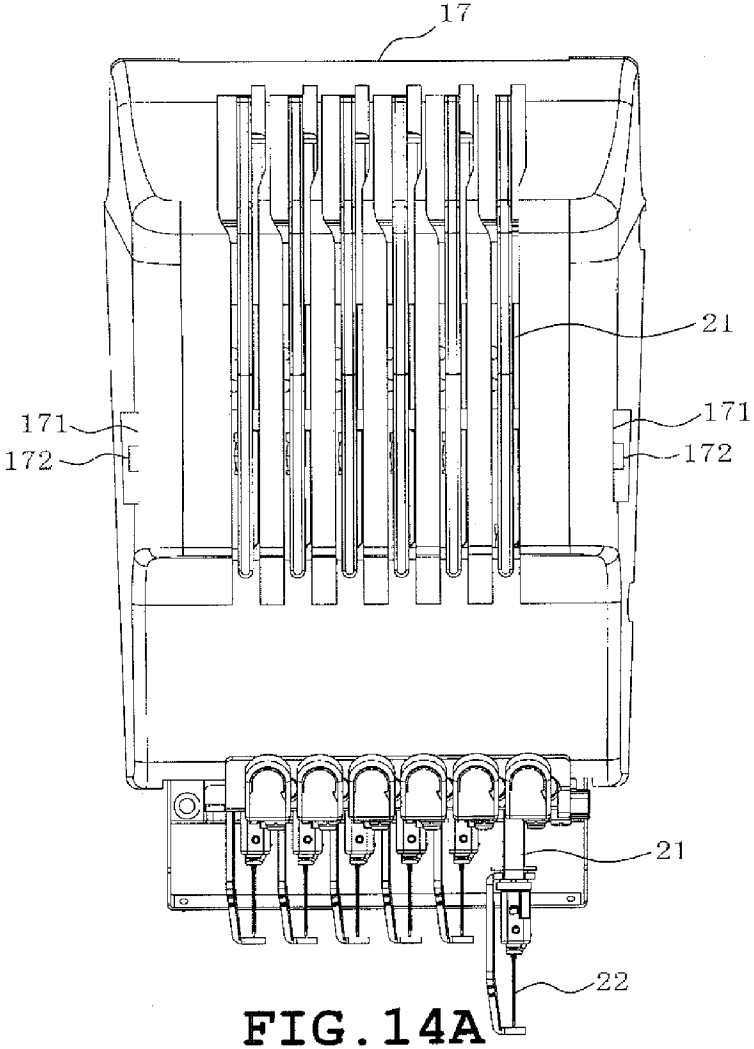
FIGS. 14A and 14B are a front view and a left side view of the support device and the needle bar case in the third embodiment respectively.
Figure 14B:
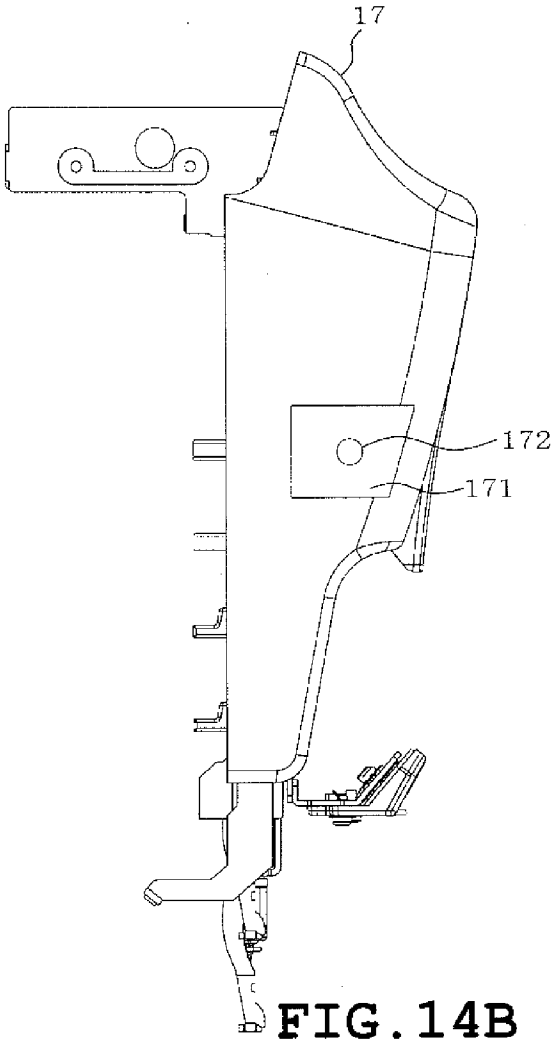

The first support member 61 has a through hole 614 formed through the right side 612 thereof. The second support member 62 also has a through hole 624 formed through the left side 622 thereof. The needle bar case 17 has two recesses 171 and two protrusions 172 provided for mounting the support device 60 as shown in FIGS. 14A and 14B. The recesses 171 and the protrusions 172 are provided on right and left sides of the needle bar case 17 respectively. The recesses 171 are formed into a groove shape such that the right and left sides 622 and 612 of the first and second support members 61 and 62 are fitted into the recesses 171 respectively. The protrusions 172 protrude rightwardly and leftwardly outward inside the recesses 171. The protrusions 172 are formed into a cylindrical shape so as to be fittable with holes 614 and 624 of the first and second support members 61 and 62 respectively.

When the support device 60 is mounted on the needle bar case 17, the user loosens the screw member 63 so that a distance between the right and left sides 622 and 612 of the second and first support members 62 and 61 is increased. The right side 612 of the first support member 61 is then fitted into the right recess 171 of the needle bar case 17, and the protrusion 172 is fitted into the hole 614. When the second support member 62 is then moved rightward, the left side 622 of the support member 62 is fitted into the left recess 171 of the needle bar case 17, and the protrusion 172 is fitted into the hole 624. The screw member 63 is tightened up in this state so that the first and second support members 61 and 62 are fixed. The support device 60 is thus mounted on the needle bar case 17.

Figure 11:
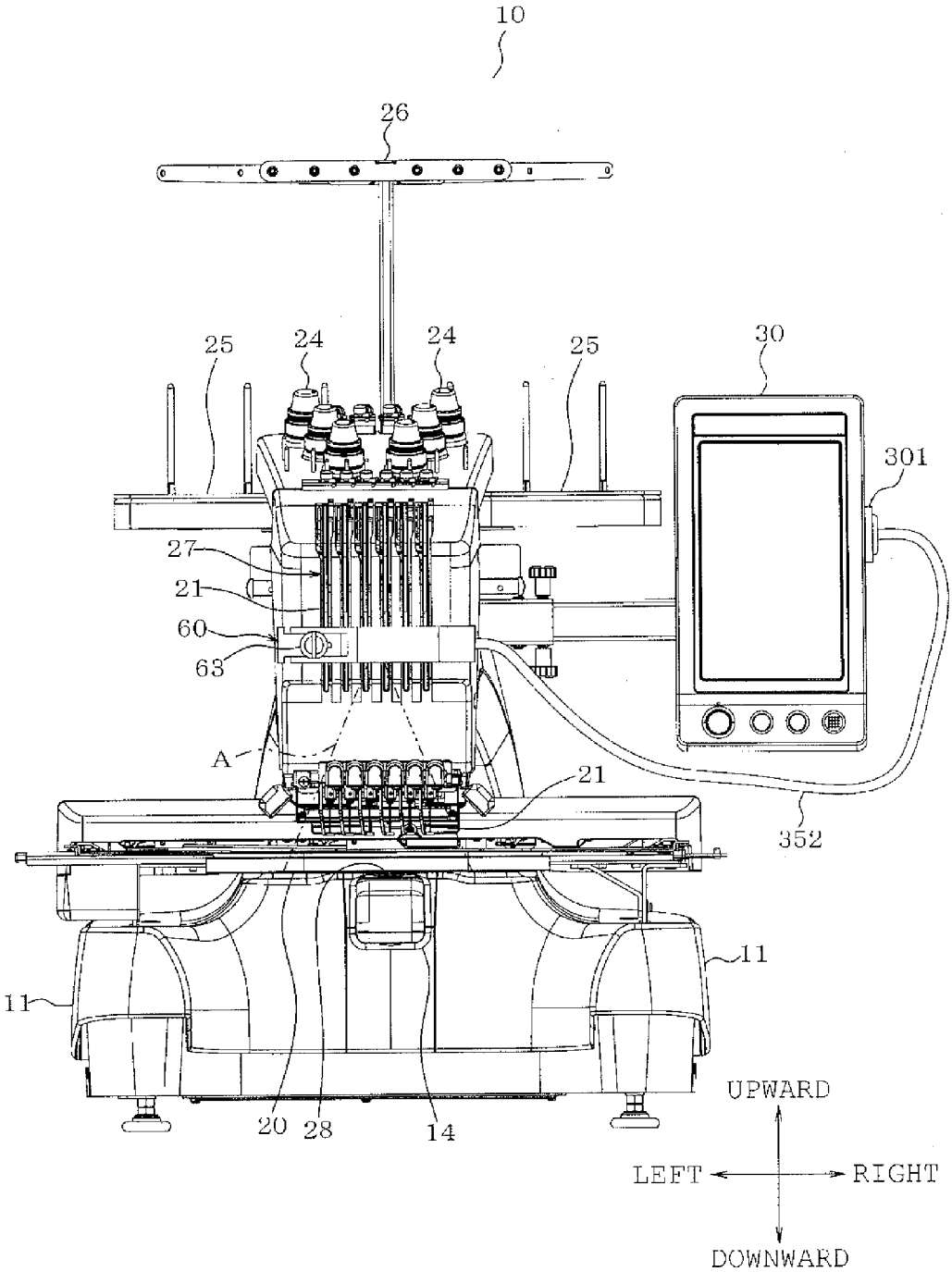
FIG. 11 is a front view of the multi-needle sewing machine according to a third embodiment.
Figure 12:
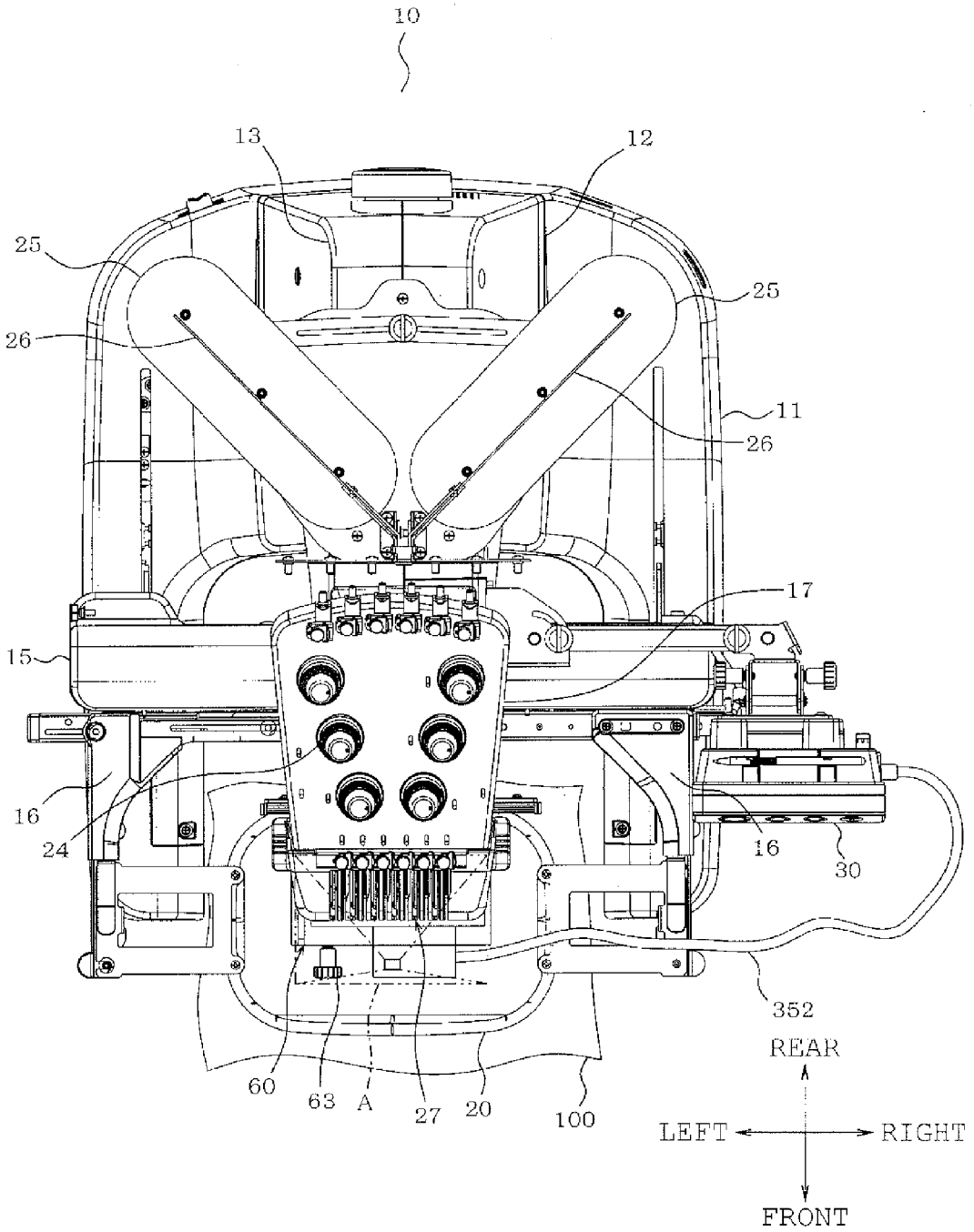
FIG. 12 is a plan view of the multi-needle sewing machine according to the third embodiment.

The projector 35 has a cable 352 which electrically connects the projector 35 to the control device 31, as shown in FIGS. 11 and 12. The cable 352 is eliminated in FIG. 13. After mounting the support device 60 on the needle bar case 17, the user connects the cable 352 extending from the projector 35 to a connector 301 of the operation panel 30. When detecting connection of the cable 352 to the connector 301, the control device 31 determines that the projector 35 is located at the first position, controlling the projector 35 so that an image is projected.

On the other hand, when detaching the support device 60 from the needle bar case 17, the user loosens the screw member 63 to detach the protrusion 172 from the holes 614 and 624 while moving the second support member 62 in the right-left direction. As a result, the support device 60 is detached from the needle bar case 17. In this case, the cable 352 of the projector 35 is disconnected from the connector 301 of the operation panel 30. Since the projector 35 is electrically disconnected from the control device 31, no image can be projected.

The third embodiment described above can achieve the same working and effect as those achieved by the first and second embodiments. Further, the projector 35 can be detached from the needle bar case 17 together with the support device 60 when the projector 35 is unnecessary. Accordingly, the projector 35 and the support device 60 can be prevented from getting in the way of user's work, with the result that a wider space around the needle bar case 17 can be ensured and workability can be further improved.

The foregoing embodiments should not be restrictive but may be modified or expanded. For example, the support device 40 may be detachably attachable to the needle bar case 17 in the first embodiment, and the support device 50 may be detachably attachable to the arm 13 in the second embodiment.

Further, a sensor may be separately provided for detecting attachment or detachment of the support device 60 in the third embodiment.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

We claim:

1. A multi-needle sewing machine comprising:
a plurality of needle bars;
a needle bar case having a thread supply path along which threads are supplied to needles attached to lower ends of the needle bars respectively, the needle bar case supporting the needle bars;
an arm on which the needle bar case is mounted;
an embroidery frame provided below the needle bar case and configured to hold a workpiece cloth;
a projector configured to project an image onto the workpiece cloth at a first position above the embroidery frame; and
a support member supporting the projector and configured to be capable of switching the projector between the first position and a second position differing from the first position,
wherein the second position is lateral to the needle bar case.

2. The multi-needle sewing machine according to claim 1, wherein the projector covers at least a part of the thread supply path when located at the first position, and the thread supply path is opened without the projector covering the thread supply path when the projector is located at the second position.

3. The multi-needle sewing machine according to claim 1, wherein:
the support member is supported so that a proximal end of the support member is swingable about a fulcrum provided on the needle bar case or the arm;
the support member has a distal end on which the projector is supported; and
the support member has a swinging range in which the support member is swung, and the swinging range has one of two ends, corresponding to the first position and the other end corresponding to the second position.

4. The multi-needle sewing machine according to claim 2, wherein:
the support member is supported so that a proximal end of the support member is swingable about a fulcrum provided on the needle bar case or the arm;
the support member has a distal end on which the projector is supported; and
the support member has a swinging range in which the support member is swung, and the swinging range has one of two ends, corresponding to the first position and the other end corresponding to the second position.

5. The multi-needle sewing machine according to 3, wherein:
the fulcrum is provided on a side of the needle bar case;
the projector covers the thread supply path provided at a front side of the needle bar case when located at the first position; and
the projector is lateral to the needle bar case and the thread supply path is open at a front side thereof when the projector is located at the second position.

6. The multi-needle sewing machine according to 4, wherein:
the fulcrum is provided on a side of the needle bar case;
the projector covers the thread supply path provided at a front side of the needle bar case when located at the first position; and
the projector is lateral to the needle bar case and the thread supply path is open at a front side thereof when the projector is located at the second position.

7. The multi-needle sewing machine according to 3, wherein:
the fulcrum is provided on the arm;
the projector covers the thread supply path provided at a front side of the needle bar case when located at the first position; and the projector is lateral to the needle bar case and opens a front side of the thread supply path when located at the second position.

8. The multi-needle sewing machine according to 4, wherein:

the fulcrum is provided on the arm;

the projector covers the thread supply path provided at a front side of the needle bar case when located at the first position; and the projector is lateral to the needle bar case and opens a front side of the thread supply path when located at the second position.

9. The multi-needle sewing machine according to 1, further comprising:

a detection unit configured to detect a position of the projector; and a control unit configured to control the projector based on a result of detection by the detection unit, wherein the control unit controls the projector so that projection of the image is allowed when the projector is located at the first position and so that the image is not projected when the projector is located at the second position.

10. A multi-needle sewing machine comprising:

a plurality of needle bars;

a needle bar case having a thread supply path along which threads are supplied to needles attached to lower ends of the needle bars respectively, the needle bar case supporting the needle bars;

an arm on which the needle bar case is mounted;

an embroidery frame provided below the needle bar case and configured to hold a workpiece cloth;

a projector configured to project an image onto the workpiece cloth at a first position above the embroidery frame; and a support member supporting the projector and configured to be capable of switching the projector between the first position and a second position differing from the first position, wherein the projector covers at least a part of the thread supply path when located at the first position, and the thread supply path is opened without the projector covering the thread supply path when the projector is located at the second position.

11. The multi-needle sewing machine according to claim 10, wherein:

the support member is detachably mounted on the needle bar case or the arm;

the projector is located at the first position when the support member is mounted on the needle bar case or the arm; and the projector is located at the second position when the support member is detached from the needle bar case or the arm.

12. The multi-needle sewing machine according to claim 10, further comprising:

a detection unit configured to detect a position of the projector; and a control unit configured to control the projector based on a result of detection by the detection unit, wherein the control unit controls the projector so that projection of the image is allowed when the projector is located at the first position and so that the image is not projected when the projector is located at the second position.

* * * * *